United States Patent [19]

Clarke et al.

[11] Patent Number: 4,521,291

[45] Date of Patent: Jun. 4, 1985

[54] COAL EXTRACTION

[75] Inventors: James W. Clarke, Tewkesbury; Geoffrey M. Kimber, Cheltenham; Terry D. Rantell, Cheltenham; Colin E. Snape, Cheltenham, all of England

[73] Assignee: Coal Industry (Patents) Limited, London, England

[21] Appl. No.: 596,562

[22] Filed: Apr. 4, 1984

Related U.S. Application Data

[63] Continuation of Ser. No. 458,838, Jan. 18, 1983, abandoned.

[30] Foreign Application Priority Data

Feb. 9, 1982 [GB] United Kingdom ..... 8203640

[51] Int. Cl.[3] ..... C10G 1/00; C10G 1/06

[52] U.S. Cl. ..... 208/8 LE; 208/10; 208/9

[58] Field of Search ..... 208/8 LE, 9, 10

[56] References Cited

U.S. PATENT DOCUMENTS

| | | | |
|---|---|---|---|
| 3,583,900 | 6/1971 | Gatsis | 208/8 LE |
| 3,598,718 | 8/1971 | Gleim et al. | 208/8 LE |
| 3,849,287 | 11/1974 | Gleim et al. | 208/8 LE |
| 4,081,358 | 3/1978 | Ton et al. | 208/8 LE |
| 4,374,015 | 2/1983 | Brulé | 208/10 |

FOREIGN PATENT DOCUMENTS

| | | |
|---|---|---|
| 494834 | 11/1938 | United Kingdom . |
| 1287570 | 8/1972 | United Kingdom . |
| 1314064 | 4/1973 | United Kingdom . |
| 1597119 | 9/1981 | United Kingdom . |
| 1603619 | 11/1981 | United Kingdom . |

*Primary Examiner*—William G. Wright

*Attorney, Agent, or Firm*—Stevens, Davis, Miller & Mosher

[57] ABSTRACT

Coal is extracted using a mixed solvent which includes a substantially aromatic component and a substantially naphthenic component, at a temperature of 400° to 500° C. Although neither component is an especially good solvent for coal by itself, the use of mixed solvent gives greater flexibility to the process and offers efficiency gains.

6 Claims, 1 Drawing Figure

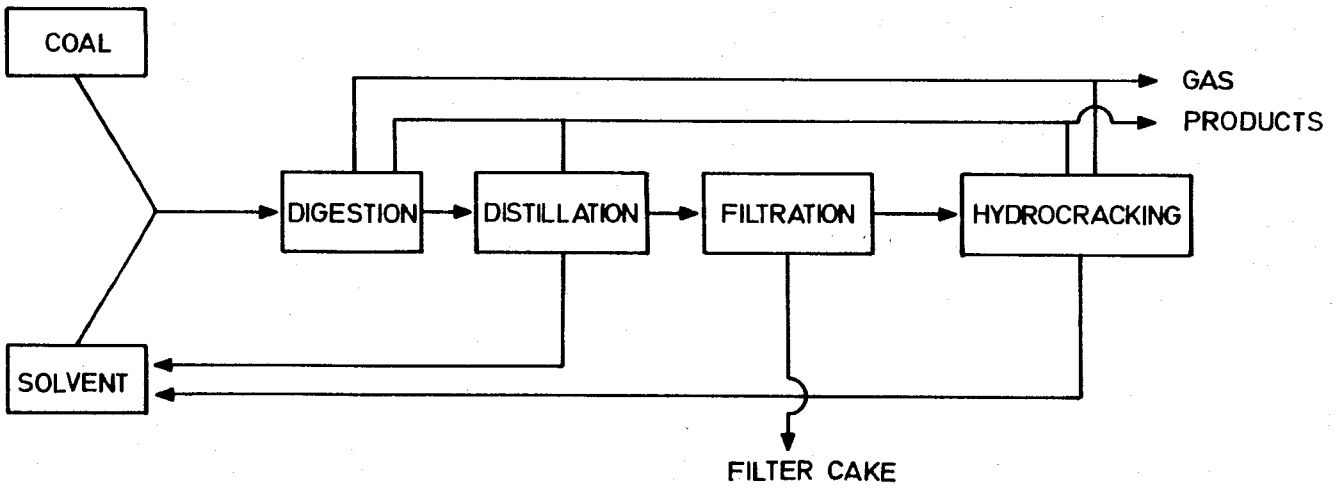
COAL
SOLVENT
DIGESTION
DISTILLATION
FILTRATION
HYDROCRACKING
GAS
PRODUCTS
FILTER CAKE

COAL EXTRACTION

This application is a continuation of application Ser. No. 458,838 filed Jan. 1, 1983 abandoned.

This invention concerns improvements in coal extraction using liquid solvents, more particularly it concerns coal extraction using liquid hydrogen donor solvents.

In the extraction of coal, there have been many proposals to add hydrogen during the dissolution step. This may be done by the use of a hydrogen donor solvent, which is a well-known class of materials capable of donating hydrogen during dissolution to the coal moieties produced by thermal bond cleavage in the coal; the most favoured solvents of this class are hydroaromatics. In an extraction process using a hydrogen donor solvent, the solvent itself loses hydrogen and has to be constantly replaced and/or regenerated. It is envisaged that in the hydrogen donor extraction of coal without the presence of gaseous hydrogen in the extraction vessel, the residual solvent and any part of the product having the same characteristics will be hydrogenated at a later stage in the process, possibly in a general hydrogenation or hydrocracking of the liquid products from the extraction step, and the resulting hydrogen donor solvent will be recycled to the extraction step. The liquid products comprise a wide range of materials, including high boiling point materials which it is desirable to convert into low-boiling higher—value liquids having a lower molecular weight. Therefore, in such a process, the hydrogenation/hydrocracking conditions are chosen to give an acceptable compromise between production of recycle solvent which is hydroaromatic but not completely saturated, and the production of the desired high value low-boiling products.

Our studies of coal extraction have led tothe consideration of the correction of a situation in which the process solent is overhydrogenated, to yield naphthenic-type materials which are not such good solvents as hydroaromatics. Such over-hydrogenation might occur because of equipment malfunction or because of deliberate or inadvertant alteration of the process conditions, and it has been observed on a pilot plant which uses recycled hydrogen donor solvent that the composition changes and the extraction ability deteriorates. In an attempt to cure this, we have discovered a method of coal extraction which offers a surprising and economically significant improvement in the yields obtainable.

The present invention provides a method of extracting coal at temperature of 400° to 500° C. using a liquid solvent comprising the use of a solvent which is a mixture of a substantially aromatic polycyclic hydrocarbon which contains three and/or four-ring molecules and has minimum boiling point of 270° C. and at least 25% by weight of the aromatic component of a substantially naphthenic polycyclic high-boiling hydrocarbon. Preferably, the aromatic component boils within the range 270° to 360° C., giving predominantly three-ring species. Preferably, the naphthenic component contains predominantly two-and/or three-ring molecules and has a cut-point in the range 180° to 300° C. Although the invention has particular application to a method of extracting coal with continuous recycles of the solvent components, as will be described in more detail hereafter, it also includes the possibility of semi-continuous or intermittent operation within a process using a recycled hydrogen donor solvent, for example to correct an imbalance in the desired properties of the coal solvent.

The invention offers flexibility in operation while retaining or improving on extraction efficiency. If the solvent or any component contains an undesirably high level of hydroaromatics, these can be reduced, for example by reaction with coal.

The present invention also provides a method for the extraction of coal in which a recycle solvent is used, comprising the extraction of coal at a temperature of from 400° to 500° C. using a solvent comprising a hydrogenated recycle solvent under conditions at which the solvent remains in the liquid phase, and in the absence of added gaseous hydrogen, in an extraction step, removing from the extract, by distillation, a substantially aromatic polycyclic oil boiling within the range 270° to 360° C., transferring a portion of the remaining liquid extract which does not contain any substantial amount of solids to a hydrocracking reactor, removing from the hydrogenated and hydrocracked product from the reactor an oil boiling in the range 180° to 300° C. which consists of a major proportion of substantially naphthenic polycylic hydrocarbons, and admixing at least a portion thereof with at least a portion of the substantially aromatic oil to form the solvent containing at least 25% by weight of the naphthenic component based on the aromatic oil for the extraction step.

The extraction step is suitably carried out under conditions broadly described in the art, using a finely divided coal, suitably of a size below 200 μm. The weight ratio of solvent to coal is conveniently in the range 1:1 to 10:1, preferably 2:1 to 5:1. The temperature and pressure conditions are preferably from 430° to 450° C. and 10 to 15 bar, respectively and solid and liquid residence times are preferably about 30 and 120 mins. respectively. The coal used may be any bituminous or subbituminous coal, but is preferably a medium to high volatile bituminous coal such as those from Annesley or Point of Ayr Collieries, England. The coal and solvent may suitably be passed into the extraction step.

The extract product from the extraction step contains solid material comprising mineral matter (ash) and undissolved coal. These solids should be largely removed before passage of the portion of extract to the hydrocracking reactor since the ash in particular can cause poisoning of the hydrocracking catalyst. Removal of the solids may be done in a number of ways including settling, centrifugation, vacuum distillation and, preferably, filtration. Preferably, the portion of extract should contain less than 0.1% by weight of ash. There will thus be a solids removal step in the method of the invention, but this may be either before or after the removal of the aromatic oil.

The distillation step to obtain the aromatic oil is carried out in a conventional manner. In addition to the aromatic oil product, other products including hydrocarbon gases and low boiling hydrocarbon oils may be removed from the extract at this stage. Preferably, the aromatic oil has cut points of 270° to 360° C. The oil will largely comprise 3-ring aromatic hydrocarbons.

Hydrocracking of the portion of extract is suitably carried out under conditions known per se, over a fixed or fluidised bed hydrocracking catalyst which may be a molybdenum or tungsten catalyst dispersed on a catalyst support such as alumina, active carbon or the like, and suitably promoted with cobalt or nickel. Commercial hydrocracking catalysts of this type are available.

The coal extract is extremely prone to polymerisation during processing, forming pitch or coke which apart from being a low value in comparison with liquid products, can cause problems inside the plant. Therefore, hydrogenation and/or hydrocracking of the heavy ends is extremely desirable to upgrade the products and to remove pitch and coke precursors. The method of the invention offers the very great advantage that by removing the need to only partially hydrogenate the recycled solvent components of the liquid extract stream, the hydrocracker can be operated under severe hydrocracking conditions, with a corresponding increase in yield of high value product fractions and a reduction of the undesired high boiling components.

The products from the hydrocracker are passed to a separator to remove gaseous products, including hydrocarbon gases, and are suitably fractionated to give a range of product streams including the desired naphthenic oil for recycle. The other products will include gasoline, naphtha and gas oil fractions and heavier oils boiling in the fuel oil ranges. These product streams may, after possible further processing, including further hydrogenation if necessary, and/or blending and formulation, be used for a wide range of substitute fuels including gasoline, Diesel, jet fuels and furnace oils, as well as feedstocks, such as naphtha, for chemical production, and lubricant oils. The process of the invention is extremely flexible and offers the possibility of concentrating production on one or two product streams depending upon the economics and values of the various products.

As has been stated, the invention includes the use of a mix of the aromatic and naphthenic oils as solvent in the method. The proportions of the aromatic and naphthenic oils may vary within quite wide limits, and may thus be chosen by experiment to give the best results for any desired starting material coal provided that the naphthenic content is at least 25% by weight of the aromatic oil. Suitably, however, the weight ratio of aromatic oil to naphthenic oil is in the range 1:0.25 to 1:5, preferably 1:0.5 to 1:1. The oils may be blended in the appropriate amounts before being admixed with the coal, or may be dosed at the appropriate rate into a pre-heater or into the extraction vessel. Surplus oil of either type may be taken as a product or for further processing.

Neither the aromatic oil nor the naphthenic oil is a particularly good solvent for coal, but we believe, without wishing to be restricted to any particular theory, that the presence of coal in the method of the invention catalyses the transfer of hydrogen giving a more effective aggregate solvent than could have been predicted from the performance of the individual solvent components. In the method of the invention, operation under the preferred conditions is believed to give increases in overall yield, comparable to a hydroaromatic oil used as a hydrogen donor solvent, and in the steady state, of several percentage points in the extraction step over the predicted results. This in itself is of considerable economic significance, but when considered with the ability to submit the extract to hard hydrocracking and with the flexibility of the method, a real advance in coal extraction technology has been achieved.

The invention may be more fully understood with reference to the accompanying FIGURE which is a block process diagram of an example of the invention.

Suitably prepared, finely-divided coal is admixed with solvent from a solvent tank in the weight ratio, solvent to coal, of 2.5:1, and is preheated to 415°–440° C. before being passed into an extraction vessel operating at 415°–440° C. and 12–15 bar pressure. Gas and light ends are removed and the product extract is passed to the distillation column providing a light aromatic product stream boiling below 270° C. and an aromatic oil boiling in the range 270° to 360° C. which is taken as a solvent stream. The remaining products are taken as one stream to a pressure filtration step operating at 300° C., yielding filter cake which after washing to remove solvent and product, may be gasified or combusted in a fluidised bed to provide process heat and steam. Because of the removal of the solvent oil and the light ends, the volume of material passed to the filter is less than in the prior proposals; the filter duty is lower and hence there is a saving in capital cost. This will not apply, of course, if the extract is filtered before distillation. The filtrate is passed to a hydrocracker operating at a liquid hourly space velocity of 0.1–0.4, temperature of 425°–440° C. and pressure of 170–250 bar. A commercial Co-Mo catalyst on alumina support is used. The product of the hydrocracker is fractionated to yield a range of hydrocarbon product streams generally entitled "product" and a cut of 180° to 300° C. naphthenic polycyclic oil which is recycled to the solvent tank in the weight ratio of 1:0.5–1:1 to the aromatic oil.

To model the method of the invention under controlled conditions in the laboratory, solvents were made up containing perhydrophenanthrene (a model fully saturated tricyclic coal solvent component) and phenanthrene (a model fully aromatic tricyclic coal solvent component). The solvents were analysed for these components before and after extraction of coal, and for comparison the solvent was heat treated in the absence of coal under the same extraction conditions. The results are given in the following Table 1:

TABLE 1

Coal: Solvent ratio by wt 2:3
Extraction conditions: 430° C. for 60 mins

| Coal | Component | Solvent wt/wt % Input | Heat-Treated | After Digestion | Extraction Yield of dmmf coal predicted* measured |
|---|---|---|---|---|---|
| Annesley Colliery | Perhydrophenanthrene | 61 | 60 | 36 | 42* 63 |
| | Tetra/Octahydrophenanthrene | 0 | 1 | 12 | |
| | Phenanthrene | 39 | 39 | 50 | |
| Point of Ayr Colliery | Perhydrophenanthrene | 56 | 54 | 15 | 43* 75 |
| | Tetra/Octahydrophenanthrene | 0 | 1 | 15 | |
| | Phenanthrene | 44 | 45 | 70 | |

*determined from the extraction yield in each component of the mixture and composition of the input solvent.

It will be observed that heat treatment of the solvent has caused only a minor change in composition of the solvent mix; there has been very little hydrogen transfer. This contrasts with the composition of the solvent after an hour in contact with coal under the extraction conditions; there has been substantial transfer of hydrogen from the saturated naphthenic solvent component, forming hydroaromatics and aromatics. It is believed that the increase in aromatics has resulted from the transfer of hydrogen from the hydroaromatics to the coal substance. The increase in extraction yield over that predicted is also noteworthy and could not have been expected.

Whereas phenanthrene and its hydrogenated derivatives are extremely useful model compounds for coal solvent oils, they are in fact less effective than some solvents. We prefer to use coal tar oils such as anthracene oil, possibly in admixture with aromatic petroleum fractions, and their hydrogenated derivatives, as these have been found to give especially good extraction yields. The above mentioned tests were also carried out using a solvent (A) which was considered to have been over-hydrogenated in the hydrocracker of a continuous coal extraction and hydrocracker pilot plant, and using a mixture of (A) and anthracene oil (substantially completely aromatic). Although the solvent A was considered "over-hydrogenated" it still contains a small proportion of hydroaromatics. The results of this series of tests are given below in Table 2:

TABLE 2

Coal: Annesley Colliery, Coal to Solvent ratio by wt 2:3
Extraction conditions: 430° C. for 60 mins

| Solvent Type | Saturated polycyclics Feed | concentration wt/wt % Removed Solvent | Extraction Yield % dmmf coal | |
|---|---|---|---|---|
| A | 41 | 37 | | 80 |
| A/anthracene oil (50:50) | 23 | 16 | predicted | 66 |
| | | | found | 78 |

Thus although the mixed solvent contained less hydroaromatics than solvent A because of dilution with the aromatics of anthracene oil, and was expected to be appreciably less effective as a solvent, the solution yields found were comparable with the solvent A results. Although solvent A demonstrated the higher overall extraction, in practical terms it was found to be a poor vehicle for the coal extract, which rapidly precipitated out of solution. The "mixed" solvent did not exhibit this defect and was overall a superior solvent. A hydrogenated anthracene oil considered as an ideal start-up hydrogen donor solvent contains 50% hydroaromatics and 6% saturates, yielding 90% extraction of the Annesley coal.

We claim:

1. A method of extracting coal at a temperature of 400° to 500° C. in the absence of added hydrogen and using a liquid solvent, comprising the use of a solvent which is a mixture consisting essentially of an aromatic polycyclic hydrocarbon which contains three- and/or four-ring molecules and has a minimum boiling point of 270° C. and at least 25% by weight of the aromatic component of a naphthenic polycyclic high boiling hydrocarbon.

2. A method as claimed in claim 1, wherein the naphthenic hydrocarbon contains predominantly two- and/or three-ring molecules and has a cut point in the range 180° to 300° C.

3. A method of extracting coal in which a recycle solvent is used, comprising the extraction of coal at a temperature of from 400° to 500° C. using a solvent comprising a hydrogenated recycle solvent under conditions at which the solvent remains in the liquid phase, and in the absence of added hydrogen, in an extraction step to form an extract, removing from the extract by distillation an aromatic polycyclic oil boiling within the range 270° to 360° C. and containing three- and/or four-ring molecules, transferring at least a portion of the remainder of the liquid extract which does not contain any substantial amount of solids to a hydrocracker and subjecting said portion to hydrocracking therein to form a hydrogenated and hydrocracked product, removing from said hydrogenated and hydrocracked product an oil boiling in the range 180° to 300° C. which consists of a major proportion of naphthenic polycyclic hydrocarbons, and admixing at least a portion thereof with at least a portion of said aromatic oil to form a recycle solvent containing at least 25% by weight of the naphthenic component, based on the aromatic oil.

4. A method as claimed in claim 3, wherein the weight ratio of aromatic oil to naphthenic oil is in the range 1:0.25 to 1:5.

5. A method as claimed in claim 4, wherein the weight ratio of aromatic oil to naphthenic oil is in the range 1:0.5 to 1:1.

6. A method as claimed in claim 3, wherein the extraction temperature is from 430° to 450° C.

* * * * *